US006178651B1

(12) United States Patent
Yancey

(10) Patent No.: US 6,178,651 B1
(45) Date of Patent: Jan. 30, 2001

(54) REUSABLE BATTER BOARD SUPPORT

(76) Inventor: Steven Mark Yancey, 5961 S. N.C. Hwy. - 16, Maiden, NC (US) 28650

( * ) Notice: Under 35 U.S.C. 154(b), the term of this patent shall be extended for 0 days.

(21) Appl. No.: 09/198,537

(22) Filed: Nov. 24, 1998

(51) Int. Cl.[7] ..... E04G 17/00

(52) U.S. Cl. ..... 33/405; 33/1 H; 248/156; 248/545

(58) Field of Search ..... 33/405, 1 G, 1 H, 33/403, 404, 411, 624; 52/165, 298; 248/545, 530, 156

(56) References Cited

U.S. PATENT DOCUMENTS

| | | | | |
|---|---|---|---|---|
| Re. 35,133 | | 12/1995 | Halloran . | |
| 1,939,007 | | 12/1933 | Heltzel . | |
| 2,562,597 | * | 7/1951 | Breuninger | 33/405 |
| 3,823,480 | | 7/1974 | Grundman . | |
| 3,861,046 | | 1/1975 | Arn . | |
| 4,022,437 | | 5/1977 | French . | |
| 4,080,739 | | 3/1978 | Ruhaak . | |
| 4,252,472 | | 2/1981 | Moraly . | |
| 4,320,608 | | 3/1982 | Deike . | |
| 4,588,157 | | 5/1986 | Mills . | |
| 4,615,156 | | 10/1986 | Deike . | |
| 4,874,149 | | 10/1989 | Miceli . | |
| 4,939,877 | | 7/1990 | Claffey . | |
| 5,076,536 | | 12/1991 | Fitzgerald . | |
| 5,123,623 | * | 6/1992 | McNamara | 248/156 |
| 5,419,055 | * | 5/1995 | Meadows | 33/404 |
| 5,473,839 | * | 12/1995 | Stidham | 248/156 |
| 5,542,187 | * | 8/1996 | Oakley | 33/404 |
| 5,778,546 | | 7/1998 | Williamson . | |

* cited by examiner

*Primary Examiner*—Christopher W. Fulton
(74) *Attorney, Agent, or Firm*—Alston & Bird LLP

(57) ABSTRACT

A reusable support for a batter board member is provided comprising at least one sleeve for receiving a batter board member attached to an elongate spike such that a batter board member received within the sleeve is supported in a substantially vertical orientation when the spike is driven into the ground. Elongate legs may be attached to the sleeve for better stability in the ground and multiple sleeves may be used for better support of the batter board member. A batter board assembly is provided wherein at least two reusable supports are driven into the ground and two batter board members are received in the supports such that the members extend substantially vertically from the ground. A horizontal batter board member is then secured between the two vertical batter board members and a control string is attached to the horizontal member. When the batter boards are no longer required, the horizontal members may be detached from the vertical member and the vertical members removed from the reusable supports. The supports are then removed from the ground and both the supports and the batter board members can be reused on subsequent job sites.

19 Claims, 4 Drawing Sheets

REUSABLE BATTER BOARD SUPPORT

FIELD OF THE INVENTION

This invention relates to the field of construction devices. More particularly, this invention relates to a reusable batter board support and to a method for using the support in the construction of batter boards.

BACKGROUND OF THE INVENTION

An initial step that must be taken during the construction of a new building is to determine the exact locations of the building corners and to mark these locations on the ground. Batter boards are commonly used for this purpose. Specifically, batter boards are constructed where the corners of a building are to be located and then rope or cord is strung between the batter boards to mark the perimeter of the building. The "control lines" are approximately level and once completed the batter boards and corresponding control lines provide a representation of the outer perimeter of the building to be constructed. A large number of batter boards are used during construction of most new buildings.

Batter boards are typically made from 2×4s that have been sharpened on one end and then driven into the ground with a sledgehammer. One or two wooden boards are then nailed horizontally between two vertical 2×4s. The horizontal members serve as an attachment point for the control strings. A typical corner would have an "L-shaped" batter board construction consisting of three vertical 2×4s and at least two horizontal wooden members. In this way, control lines can be attached to each of the wooden horizontal members and these control lines would intersect where the corner of a building is to be located.

There are several problems associated with the conventional method of assembling batter boards. Many of these problems are associated primarily with the vertical batter board members that are driven into the ground. First, one end of each vertical member must be sharpened to facilitate driving the vertical member into the ground. This sharpening evolution is very time consuming because a typical construction project uses many vertical batter board members. Second, the vertical members are often damaged or destroyed while being driven into the ground. This is because the blunt end of a vertical member deforms or splits as it is being repeatedly struck by a sledgehammer and because the member may hit a rock beneath the surface and splinter with continued pounding. Third, it is often difficult or sometimes even impossible to drive the wooden vertical members into hard ground. For these reasons, when conventional batter boards are no longer required, the vertical members are usually removed from the ground and thrown away because they have been damaged during installation. This practice adds costs to a construction project because lumber used to make the batter boards is wasted.

In U.S. Pat. No. 3,861,046 there is disclosed a batter board design in which a horizontal tubular cross member is adjustably supported on a pair of vertical metal posts and on a pair of angle braces by a plurality of "J-shaped" mounting bolts secured at each end of the horizontal tubular cross member. A slide is mounted on the cross member between the two angle braces to serve as a tie point for the construction control lines.

In another batter board system, U.S. Pat. No. 4,080,739 discloses a system in which two horizontal alignment members are supported by two vertical post members. The upper alignment member is fixedly connected to the two post members by a pair of end caps. The lower alignment member is slideably connected to the vertical post member by a pair of couplings. Also, a slide member to which a control string may be attached is connected to the lower alignment member.

U.S. Pat. No. 3,823,480 discloses another batter board design in which a pair of pivotally connected rectangular frames are spread open 90° and supported in this position by a plurality of stakes and a brace extending between the two rectangular frames. A line holder is slideably connected to the upper horizontal member of each frame.

As illustrated by the prior art, one approach used in the art to address the problems of conventional wooden batter boards is to propose an entirely new batter board construction. Typically, also as illustrated above, the new constructions proposed involve the use of metal batter board components and a plurality of special couplings and slides to construct a reusable batter board. But such designs also have disadvantages. For example, many such designs are cumbersome to use on a job site because they require a workman not only to keep track of a great many special components, e.g., J-shaped hooks, couplings, slide members, stakes, and braces, but also to assemble each of these various specially-designed components in the proper manner on the job site. Additionally, because a great many batter boards are generally used in each construction project, purchasing entire new metal batter board assemblies is expensive. Moreover, if any of the specially-designed components are ever lost or stolen—a distinct possibility in an outdoor construction site—then those components must be replaced by other specially-designed components and this replacement may delay construction.

It is the inventor's belief that previous attempts to address shortcomings in the conventional batter board art have failed to properly identify the problem. Specifically, it has been found that the problem with conventional batter board design is not that wooden 2×4s and nails are used as the materials. In fact, the widespread prevalence and continued use of these materials in batter board construction indicates that the conventional approach has many advantages. Perhaps the greatest of these advantages is that the conventional approach utilizes materials (2×4 lumber and nails) and tools (a hammer and a sledgehammer) that are well known in the construction industry, simple to use, and plentiful on a job site. Thus, the inventor has discovered that the problem is not that wooden 2×4s and nails are used to construct batter boards, but rather that these materials cannot be reused because the vertical 2×4 members are destroyed while being driven into the ground. Also, time is wasted sharpening points on the end of 2×4s used as vertical batter board members. Because conventional batter board materials cannot be readily reused on another construction site, time and money spent in procuring and assembling these materials is wasted. Thus, there is a need in the batter board art for a way to construct conventional wooden batter boards without destroying the boards in the process so that the boards can be reused in other construction projects.

It is therefore an object of the present invention to provide a reusable batter board system. This new way of constructing batter boards is effective regardless of ground type—i.e., it is effective in hard ground and in rocky soil, and this new way would eliminate the need to individually sharpen each vertical batter board member.

Another object is to provide this new method of assembling batter boards, which would not require the use of special tools which are not commonly found on construction sites or the use of elaborate assemblies that must be brought to the construction site in addition to the normal construction materials.

SUMMARY OF THE INVENTION

The present invention overcomes the drawbacks associated with conventional batter board construction by providing a reusable support comprising an elongate spike and at least one sleeve for receiving a batter board member. The sleeve has an outer surface that is attached to the spike and an inner surface that is adapted and positioned such that when the spike is driven into the ground a batter board member can be received within the sleeve and thereby supported in a substantially vertical orientation.

In one embodiment of the present invention, two spaced sleeves are provided on an elongate spike and a pair of elongate legs for engaging the ground extends from one of the sleeves. In this embodiment, each sleeve is spaced a predetermined distance from each end of the elongate spike and also spaced a predetermined distance from the other sleeve. In this way, a batter board member can be supported in a substantially vertical orientation when the member is received within both sleeves and the elongate spike and pair of elongate legs are driven into the ground. This embodiment is advantageous because the pair of spaced sleeves provide excellent longitudinal support for the batter board member and because the elongate spike and pair of elongate legs provide excellent ground stability because three protrusions from the reusable support engage the ground. This stability is further increased in the embodiment wherein each of the elongate legs is substantially L-shaped.

The sleeves of the present invention may either be open or closed and in one embodiment of the present invention each sleeve is comprised of a rectangular tubular member. A square-shaped sleeve is within the definition of "rectangular." An "open sleeve" is a sleeve wherein the walls of the sleeve do not form a closed shape. In one embodiment of the present invention, at least one hole extends through the sleeve wall and a securing pin, such as a nail, is inserted through the hole and into a batter board member received within the sleeve to help secure the batter board member to the reusable support.

The present invention also embodies the assembling of a batter board structure by the steps of driving at least two reusable batter board supports into the ground near the location of a building corner and inserting two batter board members into the reusable supports. A horizontal member is then secured between the two batter board members that are supported in the reusable support. A control string is then attached to the horizontal member to assist in locating the position of a building corner.

A batter board construction can also be assembled according to the present invention by using three reusable supports, three batter board members received therein, and two or more horizontal batter board members connecting the three member being supported in the reusable supports. In this embodiment, control strings can be attached to the two horizontal batter board members such that the control strings intersect to denote the exact location of a building corner.

The present invention overcomes the drawbacks of conventional batter board constructions while retaining the advantages thereof. More particularly, when using the present invention it is unnecessary to sharpen the ends of wooden 2×4s that will be driven into the ground. Moreover, the 2×4s are not destroyed during construction because they are not struck with a sledgehammer or forced into hard or rocky ground during the process. Rather, reusable supports according to the present invention are driven into the ground at locations where a substantially vertical batter board member is desired. Wooden batter board members such as 2×4 are then inserted into the sleeves of the reusable supports and horizontal members are then attached to the substantially vertical batter board members. The substantially vertical batter board members may be further secured in the reusable support by driving a nail through holes provided in the sleeves of the reusable supports. Control lines can then be attached to the horizontal members and the batter board construction is complete. When the batter board members are no longer needed, the nails can be removed, if used, and the wooden 2×4s or other batter board members can be removed from the reusable supports and both the batter board members and the supports can be reused on other job sites. The present invention thus saves both time and money because workmen are no longer required to sharpen the numerous 2×4 tips and because materials used to construct the batter boards are not damaged and may be reused. Importantly, all this is accomplished without requiring the use of special tools or special batter board assemblies that are not conventionally found on construction sites.

BRIEF DESCRIPTION OF THE DRAWINGS

Other advantages of the present invention will become apparent upon reading the following detailed description and the appended claims and upon reference to the accompanying drawings in which:

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein. Rather, it will be understood that I intend to cover all alternatives, modifications, and equivalents as may be included within the spirit and scope of my invention as defined by the appended claims.

Figure 1:
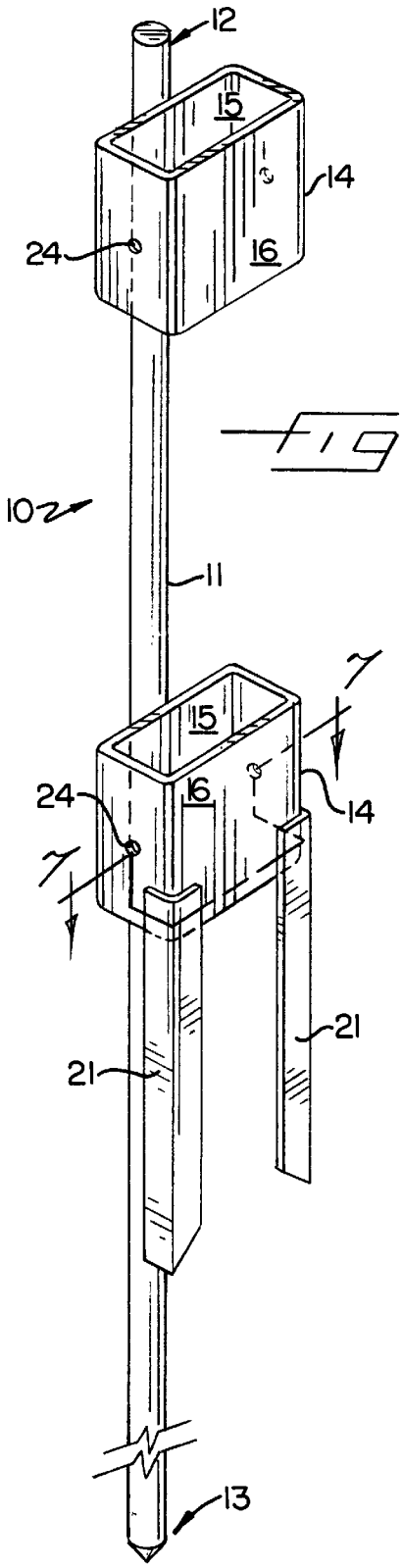
FIG. 1 is a perspective view of one embodiment of a reusable support for a batter board member according to the present invention.

Turning first to FIG. 1, there is shown a reusable support for a batter board member 10 comprising an elongate spike 11 having a first end 12 and a second end 13. A pair of sleeves 14 are provided; the outer surface 16 of each sleeve is attached to the elongate spike. A pair of elongate legs 21 are provided on the lower sleeve 14. Each sleeve may be provided with a hole 24 extending through the sleeve wall and thereby connecting the outer surface 16 of the sleeve with the inner surface 15 of the sleeve.

Figure 2:
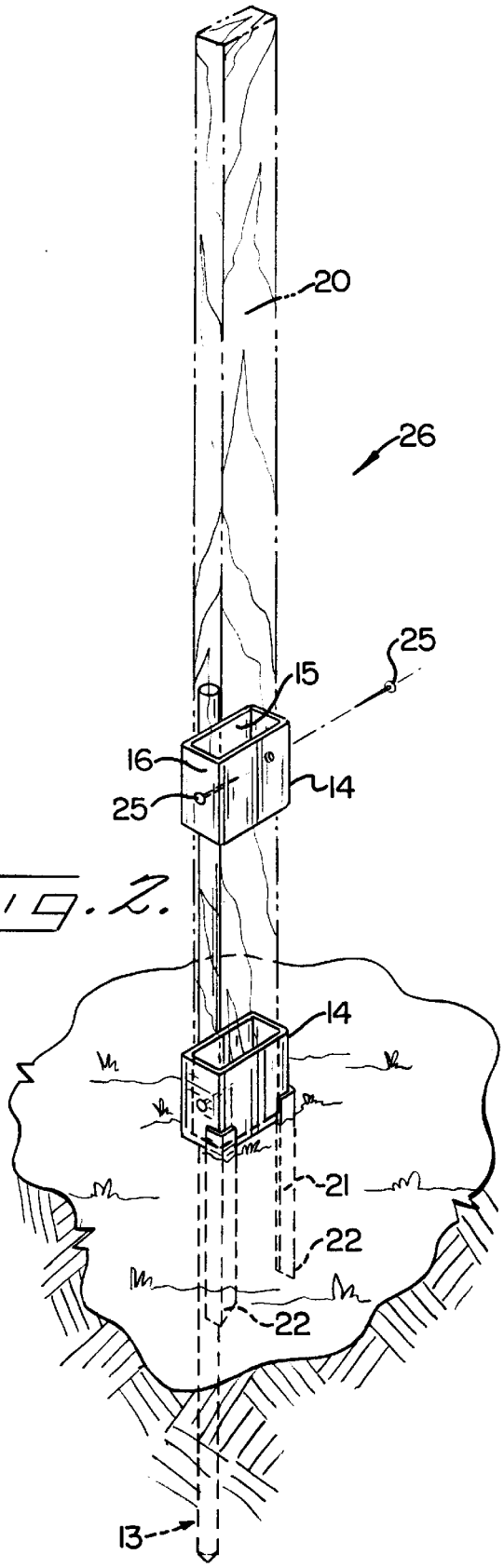
FIG. 2 is an environmental perspective of a batter board construction of the present invention.

A batter board construction 26 may be formed using the reusable support 10 in accordance with the present invention, as shown in FIG. 2. In this construction, a reusable support 10 is driven into the ground to the point where the lower sleeve 14 is at or above ground level. At this point, the second end 13 of the elongate spike and the first end 22 of each elongate leg are below ground level. While the elongate legs 21 are not present in all embodiments of the present invention, it has been found that including the elongate legs on a reusable support in accordance with the present invention increases the stability of the support in the ground. This is especially true in that embodiment of the present invention wherein each elongate leg has a substantially L-shaped cross section, as illustrated in FIG. 2. In that embodiment, the pair of L-shaped elongate legs 21 acts to pinch the ground between each leg and the portion of the elongate spike 11 that is below ground level. This pinching action increases the stability of the reusable support 10 in the ground. Once the reusable support has been hammered into the ground, as by using a hammer or sledgehammer against the first end 12 of the elongate spike, a batter board member 20 can be inserted into the sleeves 14. If desired, a securing pin 25, such as a nail, can be inserted through a hole 24 in each sleeve to more securely hold the batter board member 20 in the reusable support 12.

Figure 3:
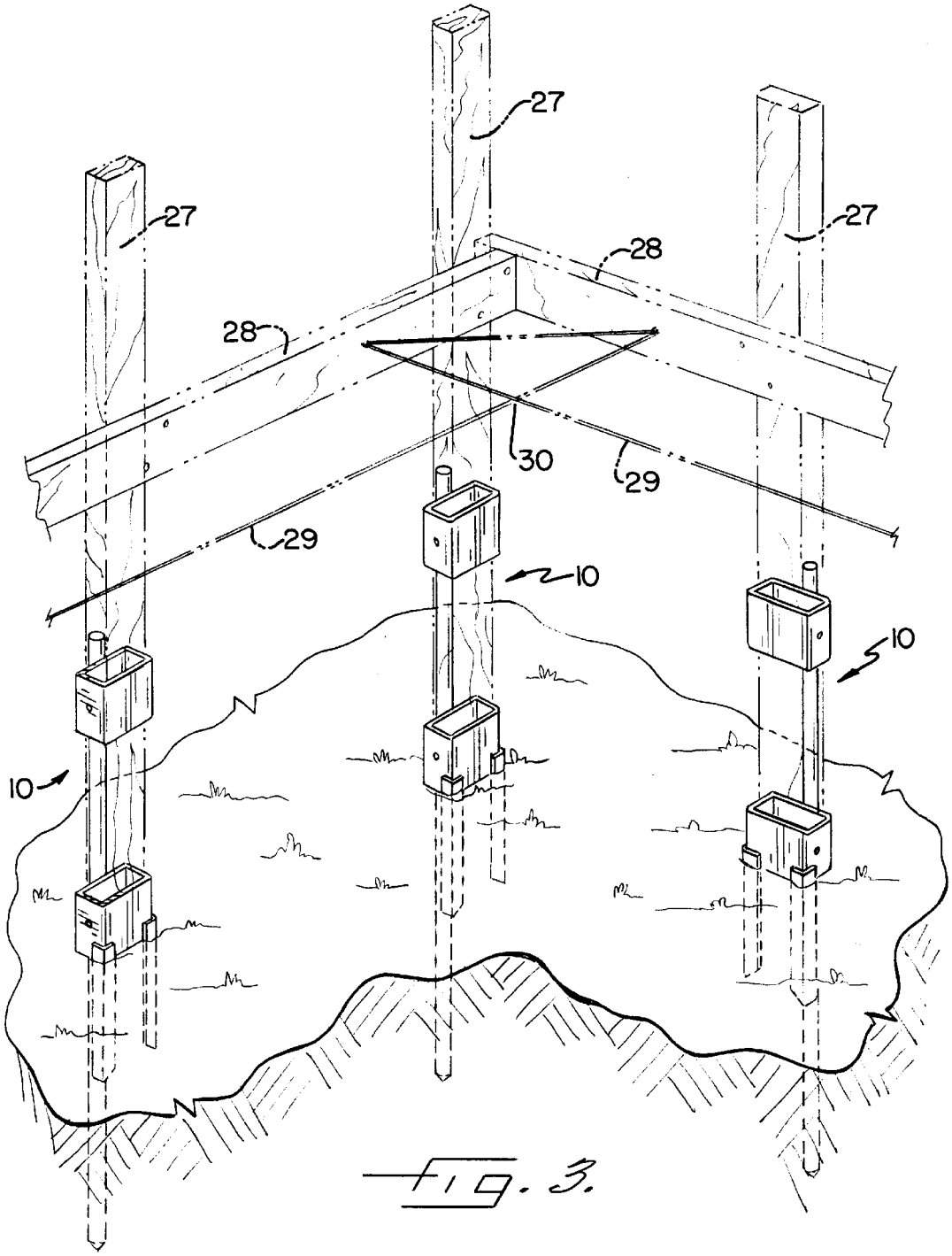
FIG. 3 is another environmental perspective view of a batter board construction according to the present invention.

Several batter board constructions may be assembled in accordance with the method of the present invention to form a batter board design that is typically used in the construction industry to mark the corners of buildings before construction begins. According to this method, a first reusable support for a substantially vertical batter board member 10 is driven into the ground near where the corner of a building is to be located. A first vertical batter board member 27 is then positioned in the reusable support 10. A second reusable support for vertical batter board member 10 is driven into the ground a predetermined distance away from where the first support is located and a second vertical batter board member 27 is then positioned in the second reusable support. A horizontal batter board member 28 is then attached between the two vertical batter board members. If desired, a third reusable support and a third vertical batter board member can be constructed to support a second horizontal batter board member 28 as shown in FIG. 3. This configuration of batter boards is particularly advantageous because a control string 29 can be attached to each of the horizontal batter board members 28 so that the intersection point 30 of the control string denotes the intended location of a building corner.

As used herein, the term "substantially vertical" is not intended to define a precise angular measurement of the vertical member relative to the ground. For example, the term "substantially vertical" is not intended to be limited to a vertical member that forms a 90 degree angle with the ground. Rather, the term "substantially vertical" is used herein to distinguish the present invention from those batter board supports that support wooden members in a horizontal direction on the ground so that, for example, the horizontal wooden member can be used as a form or barrier for pouring concrete or the like. Thus, as used in the present invention, the term "substantially vertical" is intended to refer to those batter board members that protrude from the ground in a generally upright direction, but this direction can be at some angle other than 90 degrees relative to the ground.

Figure 4:
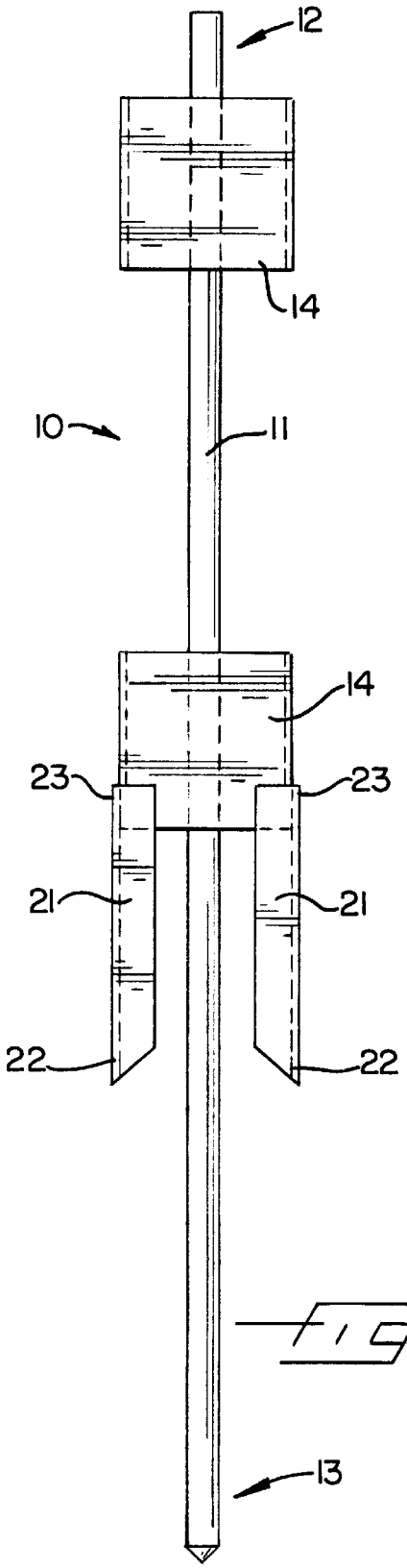
FIG. 4 is a front elevation view of a reusable support for a batter board according to the present invention.

The reusable support 10 of one embodiment of the present invention, as illustrated in FIG. 4, comprises an elongate spike 11 having a first upper end 12 and a second lower end 13. The spike is made of a material that can withstand being driven into hard ground and one that is capable of supporting a batter board member when such a member is received within a sleeve 14, forming a two-face beveled point in the lower end 13 of the elongate spike is preferable to using a blunt end and to forming a one-face point on the elongate spike. A two-face beveled point on the spike assists in driving the elongate spike straight into the ground. If the point is a single face point, then the spike will drive into the ground at an angle. Also, while the elongate spike 11 illustrated in the present application is circular in cross section, other cross-sectional geometries such as a triangle, rectangle, or other polygonal shape may be used within the scope of the present invention.

Each sleeve (upper sleeve and lower sleeve) 14 is spaced a predetermined distance from the first and second ends of the elongate spike, 12, 13, and from each other. This embodiment is advantageous for several reasons. First, spacing the sleeves 14 a predetermined distance from the first end 12 of the elongate spike allows a workman to drive the reusable support into the ground by hammering on the first end 12 of the elongate spike. This first end may be blunt to assist in providing a hammering surface or, alternatively, a hollow tapered tube (not shown) may be placed over the first end 12 of the elongate spike to be used as a hammering surface. Having a predetermined distance between the first end 12 of the elongate spike and each sleeve 14 allows the support to be driven into the ground without the need for hammering directly on the sleeve itself, which would deform the sleeve and limit its reusability. Another advantage of having each sleeve spaced a predetermined distance apart, is that using two spaced sleeves provides significant support to a batter board member received in the sleeves without having to use a long single sleeve.

Finally, mounting the sleeve 14 a predetermined distance from the lower end 13 of the elongate spike allows for part of the spike to be driven into the ground to support the batter board member without necessitating that the batter board member received in the sleeve be itself under ground level. Because wooden boards such as 2×4s are often used as batter board members, although the present invention is not limited to the use of such wooden members as metal, plastic, composites, or other materials may be used as batter board members, it is desirable that all of the batter board member be above ground so that less material may be used to form the batter board member and would otherwise be required to achieve the same height above ground in those apparatuses wherein part of the batter board member is below the surface of the ground.

While the present invention is not limited to a single material for use in the elongate spike, it has been found that cold rolled steel is a suitable material and such steel is advantageously sold in a ¾ inch diameter rod. Moreover, while the present invention is not limited to a specific overall length, it has been found that an elongate spike of 36 inches in length is suitable for use in the present invention. Moreover, the elongate spike of the present invention may be solid or, if suitable materials are used, the spike may be hollow.

In one embodiment of the present invention, a pair of elongate legs 21 are provided. While these legs need not necessarily be present in a reusable support of the present invention, it has been found that adding elongate legs to the reusable support increases the stability of the support in the ground and thus the ability of the reusable support 10 to hold a batter board member in a substantially vertical orientation without significant movement. Each elongate leg 21 comprises a first end 22 and a second end 23 that is attached to a sleeve 14. Each elongate leg extends from the sleeve a predetermined length in the direction of the second end 13 of the elongate spike. Each elongate leg 21 may have any one cross-sectional geometry, such as circular, triangular, or rectangular, but it has been found that an L-shaped cross-sectional shape is advantageous. This L-shaped cross section, which can be seen more clearly in FIGS. 6 and 7, has been found to provide increased stability over elongate legs of circular cross section.

As used in the present invention, the term "L-shaped" is not limited to a configuration wherein one side of the leg is longer than the other side nor is it limited to configurations in which the two sides of the leg are separated by exactly 90 degrees. Rather, as used in the present application, the term "L-shaped" is used to generally denote that configuration wherein an elongate leg is comprised of two sides that are connected along their length so as to form an angle between the two sides. For example, standard angle iron material used in the construction industry would be considered as "L-shaped" within the present invention.

Figure 5:
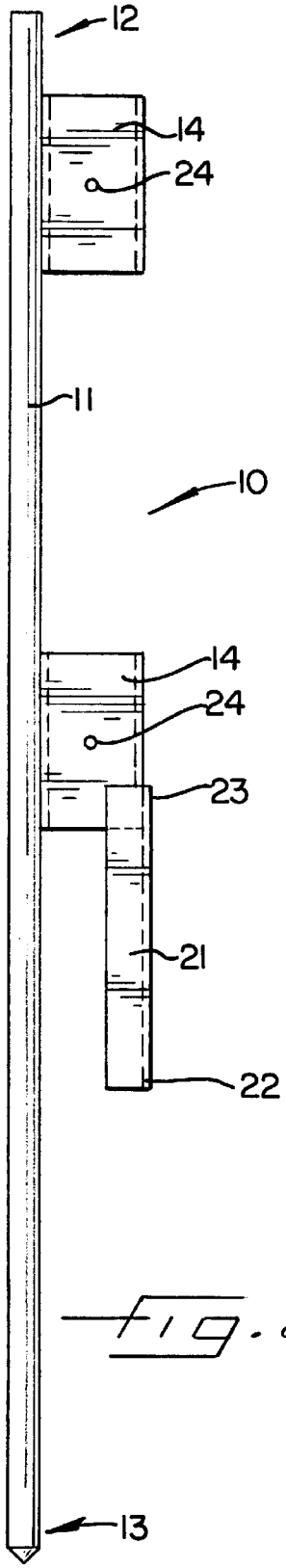
FIG. 5 is a side elevation view of a reusable support for a batter board member according to another embodiment of the present invention.

The first end 22 of each elongate leg may be pointed as illustrated in FIG. 4 or may be blunt as illustrated in FIG. 5. Providing pointed ends on the elongate legs may be advantageous, however, when the reusable support is driven into particularly hard ground. It has been found that providing a point by cutting a 45 degree angle on each side of the first end of each elongate leg is suitable for use in the present invention.

Figure 6:
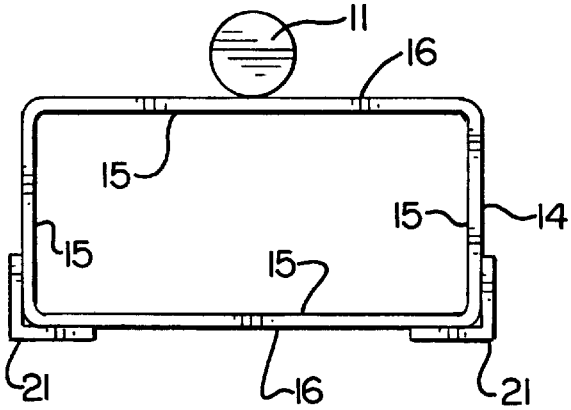
FIG. 6 is a top plan view of a reusable support for a batter board member according to the present invention.
Figure 7:
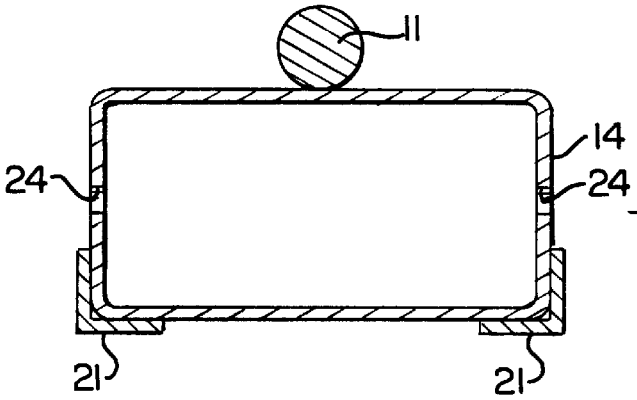
FIG. 7 is a sectional view of a reusable support according to one embodiment of the present invention, as viewed from the 7—7 line in FIG. 1.

The elongate legs 21 may be attached to the sleeve 14 by any suitable method, such as by welding, or they may be formed integral with a sleeve itself. As illustrated in FIGS. 5, 6, and 7, each elongate leg may be attached to a sleeve such that the leg is spaced a predetermined distance from the elongate spike 11 and from the other elongate leg 21. This configuration is advantageous because it has been found that the combination of an elongate spike and two spaced elongate legs engaging the ground tends to pinch the ground between the legs and between the elongate spike and in so doing provides excellent stability for the batter board member received in the sleeve 14. When compared to the traditional practice of driving a 2×4 directly into the ground, this leg and spike arrangement of the present invention provides for the ability to support a 2×4 batter board member in a substantially vertical orientation without having to drive a protrusion the size of a 2×4 into the ground. In this regard, it has been found that it is easier to drive the spike and the elongate legs of the present invention into hard ground than it is to drive an entire 2×4 into the same ground. While the present invention is not limited to any particular length of the elongate legs or to any specific material, it has been found that 1"×1"×⅛" angle iron having an overall length of seven inches and overlapping a sleeve by one inch is particularly suitable.

At least one sleeve 14 is provided in the present invention to receive a batter board member. While a single sleeve configuration is possible, using two or more sleeves is advantageous, as discussed above. A two-sleeve configuration is illustrated in FIGS. 4 and 5. Each sleeve 14 is mounted on an elongate spike 11 and in one embodiment of the present invention elongate legs 21 are mounted on one of the sleeves 14. As illustrated most clearly in FIG. 5, a hole 24 may be provided in each sleeve 14, or in one sleeve. As shown in FIG. 2, a securing pin 25 such as a nail may be driven through the hole 24 and into a batter board member 20 received in the sleeve to better secure the batter board member to the reusable support. Each sleeve 14 may be rigidly attached to the elongate spike 11 or the sleeve may be adjustably attached such that the distance between sleeves and between the first and second ends of the elongate spike and the sleeve can be varied.

Figure 4A:
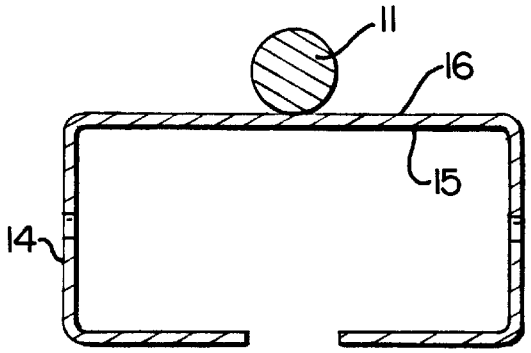
FIG. 4*a* is a cross-sectional view of the sleeve and elongate spike according to one embodiment of the reusable support of the present invention.

FIGS. 4*a,* 6, and 7 illustrate the spatial relationship between the elongate spike 11, the sleeve 14 and the elongate legs 21 and various embodiments of the sleeve itself. In FIG. 4*a,* for example, the sleeve 14 comprises an open tubular member. In FIGS. 6 and 7, the sleeve comprises a closed tubular member. In all embodiments of the present invention, the sleeve 14 comprises an inner surface 15 and an outer surface 16. The outer surface 16 is attached to the elongate spike 11. Additionally, elongate legs 21 when made from conventional angle iron material may be advantageously attached to the sleeve 14 in the position illustrated in FIGS. 6 and 7.

While the present application illustrates sleeves having a rectangular cross section, it should be understood that other cross-sectional shapes are embodied within the present invention depending, of course, on the shape of the particular batter board member to be used. For example, if a circular or triangular batter board member were desired, then the sleeve 14 could be manufactured in a circular or triangular shape respectively. Moreover, the sleeve may be manufactured from a rigid material or may be manufactured from a more flexible material. In this regard, 2"×4"×3/16" structural steel tube material has been found to be an advantageous material from which to fabricate the sleeve 14 because this material advantageously supports a conventional 2×4 board that is often used as batter board members in the construction industry.

As is apparent in FIGS. 6 and 7, each sleeve 14 is attached to the elongate spike 11 such that the longitudinal axis of the spike 11 differs from the longitudinal axis defined by each sleeve 14. This relationship is advantageous because, along with the fact that the sleeve 14 is spaced from the first end of the elongate spike 12, this relationship allows a workman to drive the reusable support into the ground by hammering on the elongate spike and not by hammering on the sleeve itself. The possibility of deforming the sleeve is thereby minimized. Also, as is shown in FIGS. 2 and 3, when the reusable support 10 of the present invention is driven into the ground, the sleeve members are positioned above ground level. There may be, of course, some portion of the lowermost sleeve member that extends slightly into the ground when the reusable support is hammered into the ground; however, the vast majority of even the lowermost sleeve remains above ground when the reusable support of the present invention is utilized. This is advantageous because it allows for the reusable support to hold a batter board member received within the sleeve 14 in a substantially vertical position without necessitating that any portion of the batter board member itself be under ground level. Thus, a shorter length of batter board member material can be used to achieve a given height above ground than what would otherwise be possible in supports wherein a portion of the batter board member itself goes under ground level.

While no particular length of sleeve material is required within the scope of the present invention, it has been found that sleeves of approximately four inches in length are suitable. Moreover, while no specific distance between two sleeves are required when two sleeves are used, it has been found advantageous to space the two sleeves on the elongate spike such that the uppermost sleeve is located approximately 18 inches above ground level when the reusable support is inserted into the ground. Such a spacing is advantageous because building codes in some states require at least an 18 inch crawl space and thus in these states such a spaced relationship between the two sleeve members can be used to help construction personnel gauge adequate crawl space height.

While the reusable support of the present invention may be constructed by any number of known fabrication techniques and from any number of known materials, one suitable method of manufacturing a reusable support comprises purchasing 2"×4"×3/16" structural steel tube material, ¾" diameter cold rolled steel rod material, and 1"×1"×⅛" angle iron material. A steel band saw is then used to cut a 36" length of cold rolled steel, two 4" sleeves from the steel tube material, and two 7" lengths of angle iron. A 45 degree cut is made in both angled sides of one end of each piece of angle iron. The uncut end of each piece of angle iron is then welded to two corners of the long side of one of the 4 inch rectangular steel tubes, leaving a one inch overlap of angle iron material on the steel tube material. Two cuts are then made on one end of the cold rolled steel to form a beveled point having two faces of approximately 45 degrees. The sleeve to which the angle iron material has been attached is then welded to the cold rolled steel such that the pointed ends of the angle iron extend in the direction of the pointed end of the cold rolled steel and such that the lowermost portion of the angle iron legs is about 11 inches or so from the beveled point of the steel rod. The second 4" piece of tubular steel is then welded to the cold rolled steel rod such that both sleeves are coaxial and such that the uppermost portion of the second sleeve will be approximately 18 inches above the lowermost portion of the first sleeve when the steel rod is driven into the ground to the point where the lowermost portion of the lower sleeve touches the ground. If desired, a ⅛" diameter hole can be drilled on one or two sides of each sleeve.

A batter board assembly can be constructed using the reusable support of the present invention by driving the support into the ground with a sledgehammer contacting the first end of the elongate spike, either directly or through the use of an additional pounding surface such as a hollow tapered steel tube fitted over the elongate spike. A batter board member such as a 2×4 can then be inserted into both sleeves and a nail driven through a hole in each sleeve and into the batter board member. Two such batter board constructions can be assembled and then a horizontal batter board member nailed to each of the vertically supported batter board members. A control line can then be attached to the horizontal member. Alternatively, three batter board constructions can be assembled as illustrated in FIG. 3 and discussed previously.

When the batter board members are no longer required, the horizontal members may be removed from the vertical batter board members and the nails removed from each sleeve, if such nails were used. The vertical batter board member may then be removed from the sleeves and the reusable support removed from the ground. In this way, both the supports and the vertical batter board members may be reused on subsequent job sites.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A reusable support for a batter board member, comprising:

an elongate spike having opposed ends, one of said ends for engaging the ground; and at least one sleeve for receiving a batter board member, said sleeve defining an inner surface and an outer surface, said outer surface being permanently affixed to said elongate spike in a fixed location along said elongate spike, and said sleeve being adapted and positioned such that when said spike is driven into the ground a batter board member received within said sleeve is thereby supported in a substantially vertical orientation.

2. A reusable support for a batter board member as defined in claim 1 wherein said at least one sleeve is spaced a pre-determined distance from each end of said elongate spike.

3. A reusable support for a batter board member wherein said at least one sleeve comprises at least upper and lower sleeves permanently affixed to said elongate spike at fixed, spaced-apart locations along said spike such that a batter board member received through both of said sleeves is oriented in a substantially vertical position.

4. A reusable support for a batter board member as defined in claim 3, further comprising a pair of elongate legs, each of said legs having a first end for engaging the ground and a second end attached to said lower sleeve.

5. A reuseable support for a batter board member as defined in claim 3 wherein the cross section of each of said elongate legs is substantially L-shaped.

6. A reusable support for a batter board member as defined in claim 3, wherein each sleeve comprises a tubular member.

7. A reuseable support for a batter board member as defined in claim 3, wherein the cross section of each sleeve is rectangular.

8. A reusable support for a batter board member, comprising:

an elongate spike having opposed ends, one of said ends for engaging the ground; and two spaced sleeves for receiving a batter board member, said sleeves being permanently affixed to said spike at fixed and invariable locations therealong, and said sleeves being adapted and positioned such that when said spike is driven into the ground a batter board member received within said sleeves is thereby supported in a substantially vertical orientation.

9. A reusable support for a batter board member as defined in claim 8 wherein each of said sleeves defines an inner surface and an outer surface and wherein said outer surface of each of said sleeves is secured to said elongate spike.

10. A reusable support for a batter board member as defined in claim 8, further comprising a pair of elongate legs, each of said elongate legs having a first end for engaging the ground and a second end attached to one of said sleeves.

11. A reusable support for a batter board member as defined in claim 10 wherein the cross section of each of said elongate legs is substantially L-shaped.

12. A reusable support for a batter board member as defined in claim 8 wherein at least one of said sleeves has at least one hole for receiving a nail therethrough into a batter board member in said sleeve.

13. A reusable support for a batter board member as defined in claim 8 wherein each of said sleeves comprises a tubular member.

14. A reuseable support for a batter board member as defined in claim 13 wherein the cross section of each of said sleeves is rectangular and is configured to receive a standard 2×4 board.

15. A reusable support for a batter board member as defined in claim 8 wherein each of said sleeves comprises an open tubular member.

16. A batter board construction, comprising:

a reusable support for a batter board member, comprising:

an elongate spike having opposed ends, one of said ends for engaging the ground;

two spaced sleeves for receiving a batter board member, said sleeves being permanently affixed to said spike at invariable locations therealong, and said sleeves being adapted to receive a batter board member therethrough; and a batter board member slideably received within said two spaced sleeves, said batter board member thereby being supported in a substantially vertical orientation when said spike is engaged in the ground.

17. A method of assembling a batter board construction, comprising the steps of:

driving a first reusable support for a vertical batter board member into the ground, the first reusable support comprising an elongate spike and two spaced sleeves permanently affixed to the spike at invariable positions therealong;

positioning a first vertical batter board member into the reusable support;

driving a second reusable support for a vertical batter board member into the ground, the second reusable support comprising an elongate spike and two spaced sleeves permanently affixed to the spike at invariable positions therealong;

positioning a second vertical batter board member into the second reusable support; and attaching at least one horizontal batter board member to the first vertical batter board member and to the second vertical batter board member.

18. A method of assembling a batter board construction as defined in claim 17, further comprising the step of securing a control line to a horizontal batter board member.

19. A method of assembling a batter board construction as defined in claim 17 wherein two horizontal batter board members are attached to the first vertical batter board member.

* * * * *

UNITED STATES PATENT AND TRADEMARK OFFICE

CERTIFICATE OF CORRECTION

PATENT NO. : 6,178,651 B1
DATED : January 30, 2001
INVENTOR(S) : Yancey

It is certified that error appears in the above-identified patent and that said Letters Patent is hereby corrected as shown below:

Column 10,
Line 29, "reuseable" should read -- reusable --;
Line 30, "claim 3" should read -- claim 4 --;
Line 34, "reuseable" should read -- reusable --;
Line 35, "claim 3" should read -- claim 6 --;
Line 66, "reuseable" should read -- reusable --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,178,651 B1
DATED : January 30, 2001
INVENTOR(S) : Yancey

It is certified that error appears in the above-identified patent and that said Letters Patent is hereby corrected as shown below:

Column 10,
Line 29, "reuseable" should read -- reusable --;
Line 30, "claim 3" should read -- claim 4 --;
Line 34, "reuseable" should read -- reusable --;
Line 35, "claim 3" should read -- claim 6 --;
Line 66, "reuseable" should read -- reusable --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*